US006856238B2

(12) United States Patent
Wootton et al.

(10) Patent No.: US 6,856,238 B2
(45) Date of Patent: Feb. 15, 2005

(54) APPARATUS AND METHOD FOR USER CONTROL OF APPLIANCES

(76) Inventors: John R. Wootton, 700 Rugby Ct., St. Louis, MO (US) 63141; F. Maury Matthews, 12 Upper Ladue Rd., St. Louis, MO (US) 63124; J. Joseph Muller, 1623 Missouri Ave., St. Louis, MO (US) 63104

( * ) Notice: Subject to any disclaimer, the term of this patent is extended or adjusted under 35 U.S.C. 154(b) by 0 days.

(21) Appl. No.: 09/931,499

(22) Filed: Aug. 16, 2001

(65) Prior Publication Data

US 2002/0021206 A1 Feb. 21, 2002

Related U.S. Application Data

(60) Provisional application No. 60/227,623, filed on Aug. 18, 2000.

(51) Int. Cl.[7] ..... H04Q 1/00; G05B 19/00

(52) U.S. Cl. ..... 340/5.61; 42/70.06; 340/572.7; 340/10.1; 340/5.62

(58) Field of Search ..... 42/70.01, 70.06, 42/70.11; 340/5.61, 572.7, 10.1, 5.62, 539

(56) References Cited

U.S. PATENT DOCUMENTS

| | | | | | |
|---|---|---|---|---|---|
| 3,939,679 | A | * | 2/1976 | Barker et al. | 42/70.01 |
| 4,354,189 | A | * | 10/1982 | Lemelson | 340/10.33 |
| 4,488,370 | A | * | 12/1984 | Lemelson | 42/70.01 |
| 4,596,985 | A | * | 6/1986 | Bongard et al. | 340/825.69 |
| 4,761,808 | A | * | 8/1988 | Howard | 379/114.14 |
| 5,349,329 | A | * | 9/1994 | Smith | 340/539 |
| 5,461,812 | A | * | 10/1995 | Bennett | 42/70.06 |
| 5,499,022 | A | * | 3/1996 | Boschini | 340/5.62 |
| 5,828,301 | A | * | 10/1998 | Sanchez | 340/539 |
| 5,896,691 | A | * | 4/1999 | Kaminski et al. | 42/70.11 |
| 5,959,530 | A | | 9/1999 | Lupien, Jr. et al. | |
| 6,034,617 | A | * | 3/2000 | Luebke et al. | 340/5.62 |
| 6,282,829 | B1 | * | 9/2001 | Mossberg et al. | 42/70.06 |
| 6,314,671 | B1 | * | 11/2001 | Gering | 42/70.11 |

OTHER PUBLICATIONS

SAND2001–3499, Unlimited Release, Printed Nov. 2001. "Smart Gun" Technology Undate. John W. Wirsbinski. Prepared by Sandia National Laboratories.

SAND96–1131, Unlimited Release, Printed May 1996. Smart Gun Technology Project Final Report. D. R. Weiss, Prepared by Sandia National Laboratories.

* cited by examiner

*Primary Examiner*—Brian Zimmerman
(74) *Attorney, Agent, or Firm*—Polster, Lieder, Woodruff & Lucchesi, L.C.

(57) ABSTRACT

Apparatus (10) and a method for rendering a weapon (12) incapable of use unless authorized by a specified individual. More than one person may be authorized to use the weapon, however only one person may be authorized to use it at any one time. Each authorized person carries a badge (14) or other device which includes an rf transmitter (TAU) capable of transmitting a coded signal to a receiver (REU) installed in the weapon in response to a coded query from a unit (EU) installed in the weapon. If a properly coded transmission is received by the weapon, it becomes capable of being fired by the person who authorized its use. However, the weapon will not fire unless the person using the weapon is also standing behind the weapon. This prevents the weapon from being turned on the person authorized to use it. The apparatus stores details of the weapon's use (e.g., who, when, and where). This information is released upon receipt of an authorized code.

30 Claims, 9 Drawing Sheets

PRIOR ART

PRIOR ART

PRIOR ART

APPARATUS AND METHOD FOR USER CONTROL OF APPLIANCES

CROSS-REFERENCE TO RELATED APPLICATIONS

This application is based upon provisional patent application 60/227,623 filed Aug. 18, 2000.

STATEMENT REGARDING FEDERALLY SPONSORED RESEARCH OR DEVELOPMENT

Not applicable.

BACKGROUND OF THE INVENTION

This invention relates to access control, and more particularly to user control of appliances. The appliances include a wide range of appliances such as personal computers, firearms including handguns, rifles, and shotguns, as well as other user controlled devices. An apparatus and method of the present invention facilitate usage of an appliance only by an authorized user or users. A particular example of the invention described herein relates to firearm safety by which only someone authorized to use a firearm can fire the weapon, and then only when that authorized person is in a preferred position (i.e., behind) with respect to the weapon. Further, the act of firing the weapon (or usage of the appliance) is recorded so data is subsequently available as to who fired the weapon and when it was fired. With respect to other appliances, the recorded information would indicate who used the appliance and when.

Referring to FIG. 3 of the drawings, in the prior art, access control is a method or procedure by which entry into a facility F (whether it be a building or a portion thereof) can be limited only to persons authorized to have access. There are a number of access control methods, one of which is referred to as RFID, an acronym for radio frequency identification. Basically operation of an RFID system is such that a person P authorized for entry into the facility is given a badge ("tag") T which includes a transmitter transmitting an rf signal of a given frequency. The signal is encoded. An rf receiver R is located at an entry E of the facility. As the person approaches the facility, the receiver receives the signal transmitted by the badge. If the signal is the proper one, the person enters the facility unimpeded. An unauthorized person is however blocked from entry. An advantage of this type access control system is that it is transparent to the authorized person since he or she has to do nothing other than approach the entry, while a barrier is otherwise imposed to block entry of an unauthorized person. Other RFID systems include toll roads where a subscriber is given a RFID tag to place in their car. As the car approaches a prescribed gate at a toll station, the rf signal transmitted by the tag is received by a receiver at the gate and the vehicle is allowed to pass unimpeded through the gate. If an unauthorized person drives through the gate, an alarm is given. RFID tags are also placed, for example, on inventory items in warehouses so movement of merchandise can be automatically tracked as the merchandise is moved into and out of the warehouse.

In certain access control situations, as described herein, it may not be sufficient, or even inappropriate, that someone has access to an appliance. This is particularly so where use of the appliance (a handgun) by an unauthorized person (a child) can be harmful to that person or others, or where use of the appliance by unauthorized person can have other detrimental effects (access to a personal computer or automobile by one not supposed to be using it, for example).

Firearm safety is currently a major health issue. There are constant reports of children coming across a handgun kept in their home with tragic results. Stolen firearms are often used in the commission of crimes. Law enforcement records indicate that the vast majority of police and other law enforcement officers are killed with their own weapons taken from them by a criminal. Currently, a number of lawsuits have been filed against firearm manufacturers because of the relatively large number of people killed or injured due to weapons (particularly handguns) accidentally discharged. In some locales there are now programs to distribute gun locks to gun owners, and some firearm's manufacturers now provide gun locks with each weapon they sell.

Referring to FIGS. 4A–4C, different types of prior art gun locks are shown. In FIG. 4A, a mechanical combination lock 102 is mounted on the grip 104 of pistol 100. To use the weapon, the operator must enter a multi-digit code and turn a manual safety knob. This disengages a locking lever which otherwise blocks operation of the gun's firing mechanism.

In FIG. 4B, an electro-mechanical lock 106 has an associated motor which blocks the firing mechanism of the weapon. The lock provides a series of operating modes including unlocked and ready, locked and secure, and time delay locked and secure. Again an operator must enter a multi-digit code to enable the weapon.

In FIG. 4C, a magnet 108 installed in the gun blocks its firing mechanism. A potential user must wear a special ring 110 on one of his fingers, the ring also containing a magnet. By properly orienting the magnets, when ring 110 is brought into proximity with pistol 100, the internal magnet 108 is pulled away from its blocking position allowing the weapon to be used.

In FIG. 4D, another prior art approach includes an attachment 112 incorporating a fingerprint scanner 114 and which attaches to handle 104 of the weapon. An electronic circuit installed in the weapon disables it from being fired. When the firearm is to be used, the user places the pad of his finger against scanner 114 which obtains an image of his fingerprint. If the scanned image compares with an image stored in the memory, the circuit enables the weapon to be fired.

Another prior art approach is a rf controlled weapon shown in FIG. 4E that includes a transponder 116 installed in a cuff 118 worn by the user on his wrist. A transmitter/receiver mounted in the weapon sends out signals. If the transponder is in proximity of the weapon, a reply signal sent by the transponder back to the weapon enables it for firing.

While each of these previous approaches has certain advantages, each also has disadvantages with respect to implementation, use, cost, and effectiveness. The most significant disadvantages, however, is with regard to safety. It has been shown, for example, that certain types of locks installed on weapons can be circumvented and the weapon fired with the lock still in place. A magnetic ring can be easily duplicated. In the case of a person wearing the transponder cuff and having his weapon taken away from him, if he is still close enough to the weapon, as would occur if he were struggling over the gun with an assailant, the weapon will still be enabled and can be used to injure or kill him.

The gun safety method described herein employs rf techniques combined with a directional control capability. It is particularly effective in controlling the use of handguns and is especially worthwhile for use by police and law enforcement officers so to eliminate incidents of harm to these individuals.

BRIEF SUMMARY OF THE INVENTION

Among the several objects of the present invention may be noted the apparatus and a method of controlling operation of a wide variety of appliances so the appliance can only be used by an authorized individual, and then only under certain specified conditions. The apparatus and method provide safe use of the appliance since only the person authorized to use the appliance is trained in its use, and where circumstances warrant, knows how to use it safely. It is a particular advantage of the invention to prevent unsafe use of the appliance, even by an authorized user.

The apparatus and method of the invention are, in one application, used for firearm safety. The apparatus, when used with a firearm enables a policeman or law enforcement agent to enable (authorize) the firearm, so it can be used while the person is on duty. Most importantly, the apparatus and method of the invention only enables the weapon to be fired when the authorized user is in a preferred position with respect to the weapon; i.e., behind it with the muzzle of the weapon pointed away from him. Thus, even if the weapon is taken away from him and he is still in close proximity to it, it cannot be used against him. This feature also is significant in non-law enforcement environments. Use of the apparatus and method with sporting firearms would prevent injury to hunters, for example, who might trip and fall while carrying a loaded rifle or shotgun. The prevention of household firearm accidents is also prevented because even if a child finds a loaded gun, he cannot accidentally discharge it. If the weapon is stolen, it cannot be used by the thief in the perpetration of other crimes.

Another feature of the invention is that more than one individual can be authorized to use the same weapon. In law enforcement or military scenarios, this means one person can use the weapon during one interval and another person at another time.

A further advantage of the invention is the use of encoded transmissions back and forth between the weapon and the authorized user. A coding scheme is employed which first prevents spoofing so that an unauthorized user cannot authorize the weapon. Next the method of the invention requires continuous, periodic reauthorization to maintain the weapon in its authorized state. The encoding of the signals sent back and forth between the weapon and authorized user is constantly changed to prevent tampering, or unauthorized use or duplication.

A further feature of the invention is that authorization of the appliance can be overridden in certain circumstances. For example, authorization to activate a firearm may be overridden in a schoolroom or courthouse.

Another provision of the invention is an apparatus and method in which a record of use of the appliance is maintained including information as to who was using the appliance at any particular time. The information is then readily accessible to one subsequently interrogating the appliance using a different code than that by which the appliance is authorized for use.

It is also a feature of the invention that the apparatus and method can be implemented as an original equipment (O.E.) feature, or can be retrofitted to an existing appliance.

Finally, it is a provision of the apparatus and method to be a reliable and relatively low cost safety and user control feature. One portion of the apparatus is easily incorporated into a weapon, PC, automobile, etc., with another portion incorporated into a badge, driver's license, or other device carried by the authorized users.

In accordance with the invention, generally stated, apparatus and a method of the present invention renders a weapon incapable of use unless authorized by a specified individual. More than one person may be authorized to use the weapon, however only one person may be authorized to use it at any one time. Each authorized person carries a badge or other device which includes an rf transmitter capable of transmitting a coded signal to a receiver installed in the weapon in response to a coded query from a unit installed in the weapon. If a properly coded transmission is received by the weapon from the correct direction, it becomes capable of being fired by the person who authorized its use. However, the weapon will not fire unless the person using the weapon is also standing behind the weapon. This prevents the weapon from being turned on the person authorized to use it. Further, a memory internal to the weapon retains a record of not only who is using the weapon at a given time, but if the weapon is discharged, how many times, when, and where.

Besides firearms, the apparatus and method of the invention are readily incorporated into other appliances whose use is to be controlled and/or which it is important to operate in a safe manner. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
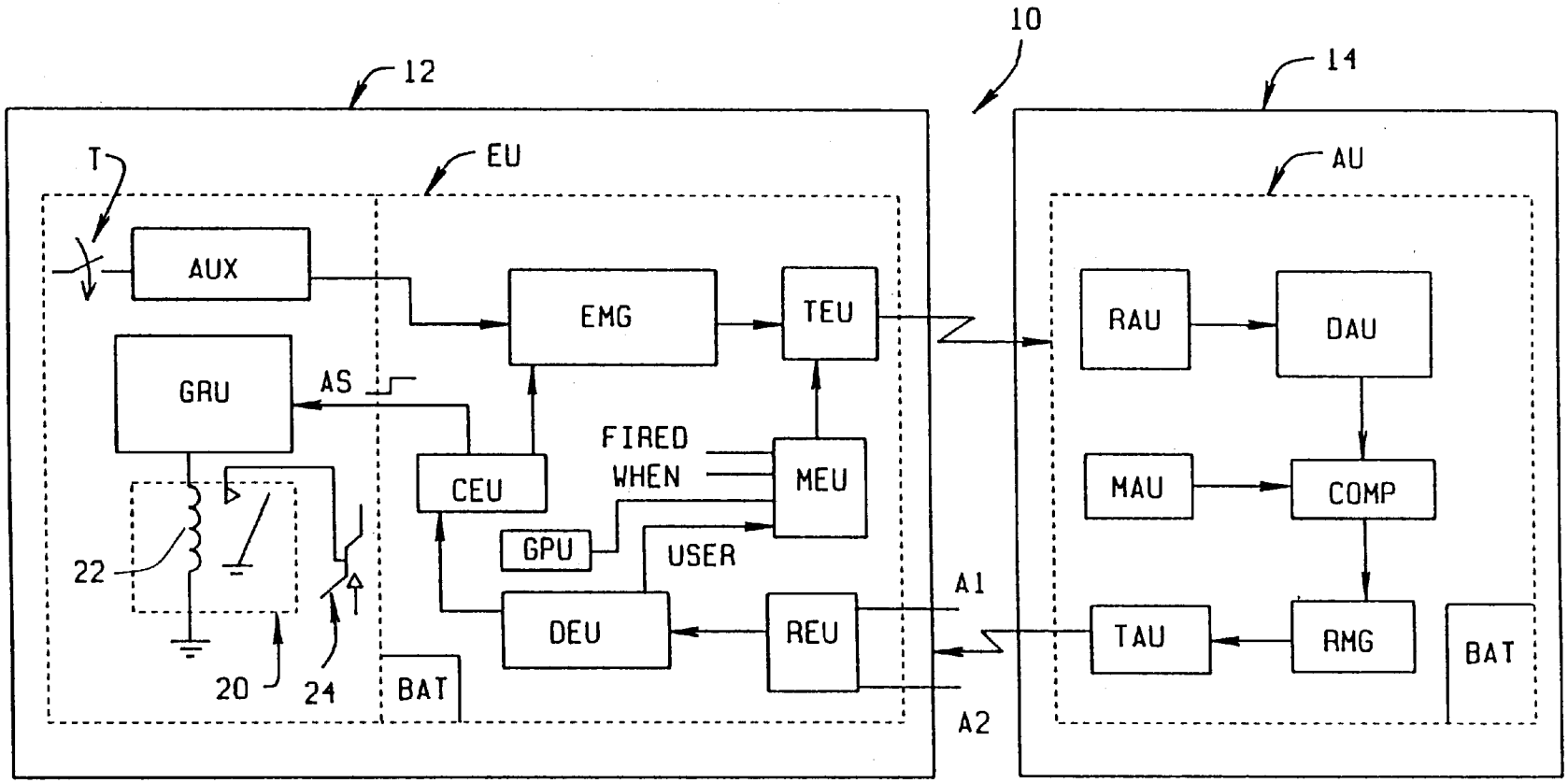
FIG. 1 is a block diagram of the gun safety mechanism of the invention.

Referring to the drawings, apparatus of the present invention for providing user control of an appliance is indicated generally 10. A representative illustration of the apparatus and method of the invention, and their use is a gun safety mechanism such as described with respect to FIGS. 1 and 2, and FIGS. 5A–5C.

As now described, a key feature of the mechanism is the communication and cooperation between an electronic unit EU contained within a gun 12, and a separate, authorizing unit AU carried by an "authorized user" of the gun. The authorizing unit is, for example, incorporated in a badge 14 worn by a policeman when on duty. Electronic unit EU, which is mounted or otherwise installed within gun 12, first includes an electronic message generator EMG. Generator EMG generates a uniquely coded waveform which, as shown in FIG. 1, is transmitted by a transmitter TEU as an rf signal to authorizing unit AU to interrogate the authorizing unit. As further discussed hereinafter, apparatus 10 allows for more than one authorized user of the weapon. Accordingly, the message embodied in the transmitted coded waveform can authorize more than one authorizing unit AU. However, the message will authorize only those authorizing units which are complementary to the particular weapon. Upon receipt of an interrogation message by a receiver RAU of an authorizing unit AU, the message is decoded by a decoding electronics section DAU of the authorizing unit. The decoded message is then compared in a comparator COMP with a message previously stored in a memory MAU within the authorizing unit to determine if this particular authorizing unit AU is one authorized for use with this particular gun 12. If it is, then a reply message generator RMG of the authorizing unit generates a reply message which also comprises a uniquely coded waveform. This reply message is then transmitted by a transmitter TAU as an rf signal back to electronics unit EU within gun 12.

A reply message receiver REU within electronics unit EU receives the message and provides it to decoder electronics section DEU within the electronics unit. Decoder DEU decodes the reply signal. An output signal AS from decoder DEU, verifying that an authorized user of the weapon has responded to the query from the electronics unit, is now used to activate the weapon.

An important aspect of the method and apparatus of the invention is that more than one person can use the weapon. In a police or military environment, this means that one officer (or soldier) can use the weapon during one shift (tour of duty), and another officer (soldier) during another shift (or tour). Since there can be more than one authorized user for a given weapon, each authorizing unit AU includes a unique code within the reply message identifying which authorized user (police officer or soldier) is replying to the interrogation message. This information is stored within a memory MEU of electronics unit EU so a record is made as to which authorized user is controlling the weapon at a given time.

Figure 2:
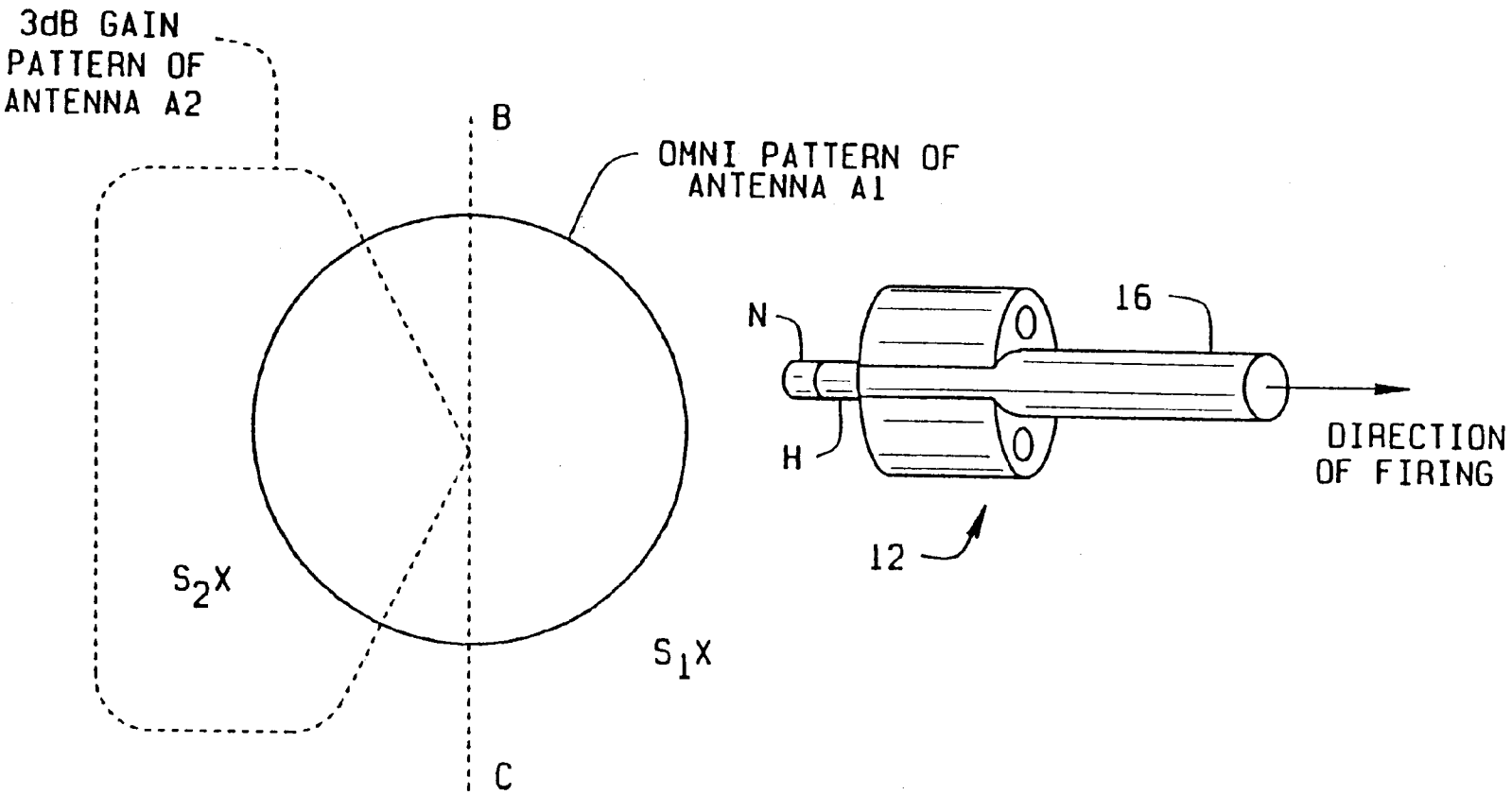
FIG. 2 illustrates a directional control capability by which a weapon can be discharged only when in a specified relationship to an authorized user of the weapon.
Figure 3:
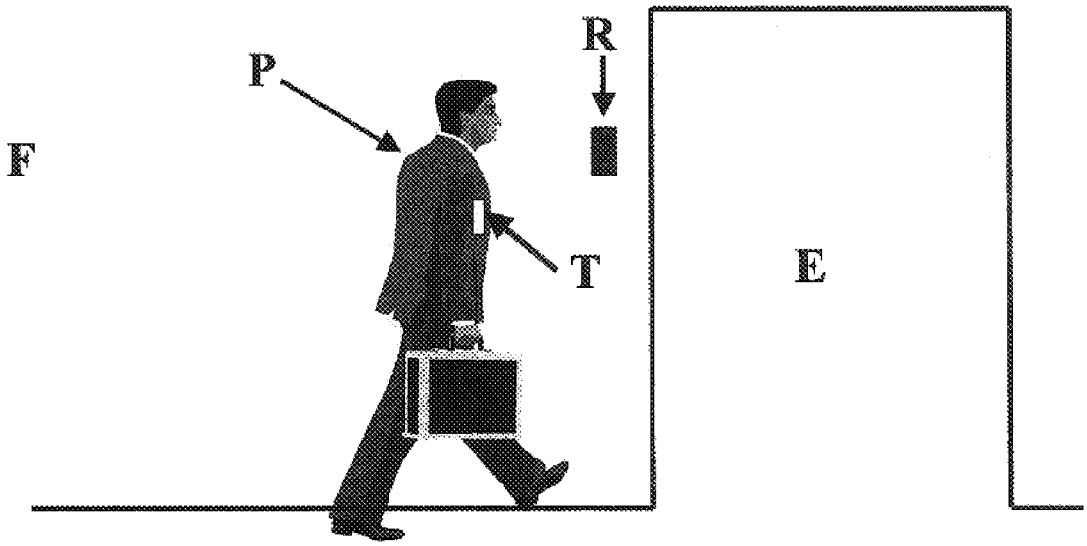
FIG. 3 is a simplified representation of a prior art access control system using RFID; and, FIGS. 4A–4E are simplified representations of prior art gun safety technologies; and, FIGS. 5A–5C illustrate use of the apparatus and method of the invention in controlling use of a firearm; and, FIG. 6 illustrates another embodiment of the invention.
Figure 4A:
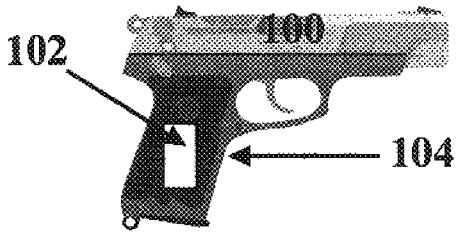
Figure 4B:
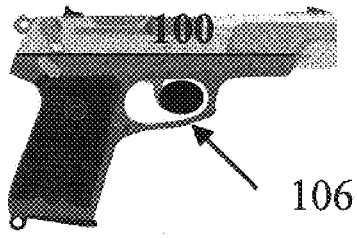
Figure 4C:
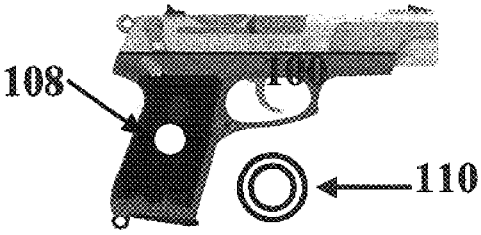
Figure 4D:
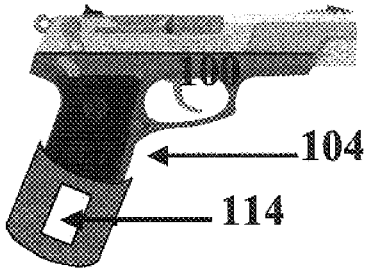
Figure 4E:
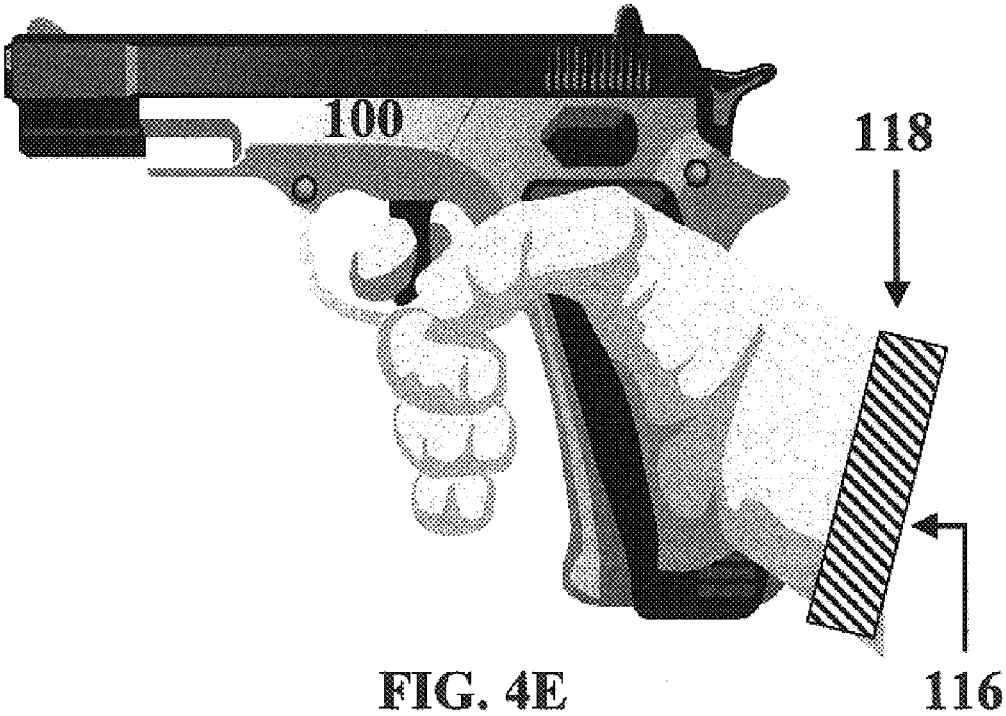

Referring to FIG. 2, receiver REU includes two separate antennas; an omni antenna A1, and a second antenna A2. Antenna A2 has a gain of 3 dB (or more) in the horizontal plane. Because it only has 3 dB of gain, antenna A2 has only 180° of coverage in the horizontal plane, i.e., it provides directional sensitivity. Antenna A2 is set up such that its principal axis is in the plane of a gun barrel 16, but points backwards away from the direction of firing of the gun barrel. The pattern of antenna A2 shown in FIG. 2 is for the horizontal plane. In the vertical plane, both antennas A1 and A2 have OdB of gain.

Differencing the signals from antennas A1 and A2 ($A_2$–$A_1$) and accepting only positive signals, ensures that only signals behind a plane BC of the gun authorizes operation of the gun. By way of example, a signal S, from the right of plane BC, results in ($S_1$×gain of $A_2$)–($S_1$×gain of $A_1$)=$S_1$×O–$S_1$×1=–$S_1$. This is a negative signal. On the other hand, a signal $S_2$ from the left of the plane BC results in ($S_2$×gain of $A_2$)–($S_2$×gain of $A_1$)=$S_2$×2–$S_2$×1=$S_2$. This is a positive signal. Further, this positive signal is measured against a threshold such that authorizing unit AU not only has to be behind plane BC, but also within a certain distance of gun 12 in order to authorize use of the weapon.

Upon receipt of a positive signal at receiver REU, the signal is decoded. If the decoded signal is from an appropriate authorizing unit AU, the decoder sends a message to a control unit CEU of the electronics unit. Upon receipt of this signal, the control unit deactivates a gun restraint unit GRU which is interconnected with the firing mechanism of the weapon. Deactivating the gun restraint unit frees the gun to fire. However, as discussed hereinafter, this is a controlled feature of the invention and the weapon must be re-authorized at predetermined intervals or else it will again be rendered unusable.

Control unit CEU performs a number of tasks. First, as described above, the control unit controls provides activation signals to the gun restraint unit. Second, the control unit effects a query and response cycle through message generator EMG. The query/response cycle is, for example, triggered once every second. If a correct response is received, and gun 12 has already been activated, the gun remains activated for another 1–2 seconds. In effect, gun 12 remains continuously activated in the presence of continuous queries from the gun's electronics unit and affirmative responses from the authorization unit carried by an authorized user of the weapon. If the weapon has been activated, but subsequently does not receive an affirmative response to a query, a second query and response cycle is immediately initiated. If an appropriate response is again not received, weapon 12 is rendered inactivate by gun restraint unit GRU. The initial interrogation cycle (the one second query/response cycle) then recommences. It will be understood by those skilled in the art that the time intervals specified herein are exemplary only and that other timing can be used. It will further be understood by those skilled in the art that the codes used in practicing the method of the invention can be automatically changed at predetermined intervals, including each time an interrogation signal and response signal are sent. Changing the coding makes it extremely difficult for unauthorized users to enable the appliance.

Both electronics unit EU and authorization unit AU are battery operated by batteries BAT. Battery life is dependent upon operational life and all attempts are used to preserve the battery life. Typical operations should achieve a 10 year life. A similar 10 year life is anticipated for the separate battery that operates the authorization unit. In one embodiment, the battery that resides in the gun is a rechargeable unit. However, issues of gun safety during recharging outweighs certain advantages this might offer.

In the electronics unit, control unit CEU minimizes power consumption. To save battery life, an auxiliary circuit AUX is employed which starts the query/response cycle. This circuit is activated, for example, when a person grips a handle of the gun. Picking up the gun by its handle closes a contact T which activates this interrogative and answer sequence. When the gun is no longer being held, the activates the auxiliary circuit to commence an interrogation cycle and to continue the cycle for a specified interval; for example, 15 seconds. With a positive response, the weapon is activated as above described. Otherwise, after the interval, control unit CEU returns electronics unit EU to a quiescent state in which essentially no power is consumed and in which the weapon is deactivated.

The interaction between authorization unit AU and electronics unit EU is to establish whether gun 12 is disabled or enabled. Gun restraint unit GRU actually enables or disables the weapon. The gun restraint unit is a fail safe device since in the event of loss of battery power, for example, the gun is disabled.

Apparatus 10 is available in two models. In one model, the gun is manufactured with apparatus 10 built in. In the other model, gun 12 is retrofitted with the apparatus. The apparatus includes, for example, a solenoid 20 which, when its coil 22 is deactivated, blocks the mechanical motion of the gun's hammer or trigger. When gun 12 receives an authorization signal AS from control unit CEU, coil 22 is energized and solenoid 20 retracts to clear the firing mechanism. Solenoid 20 is a discrete solenoid which operates in conjunction with a semiconductor 24. The hammer and/or the trigger are now free to operate normally. Apparatus 10 does not supersede, interfere with, or otherwise effect a mechanical safety with which the gun is usually provided. Both apparatus 10 and the mechanical safety have to be disengaged before the weapon can be fired.

Figure 5A:
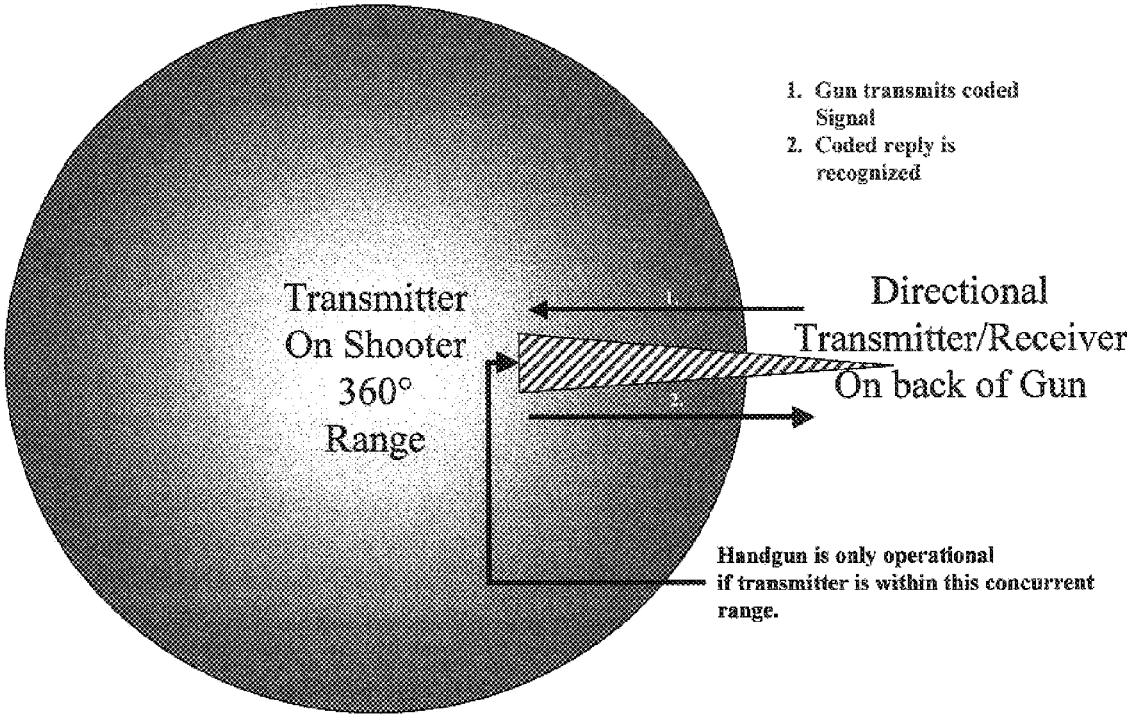
Figure 5B:
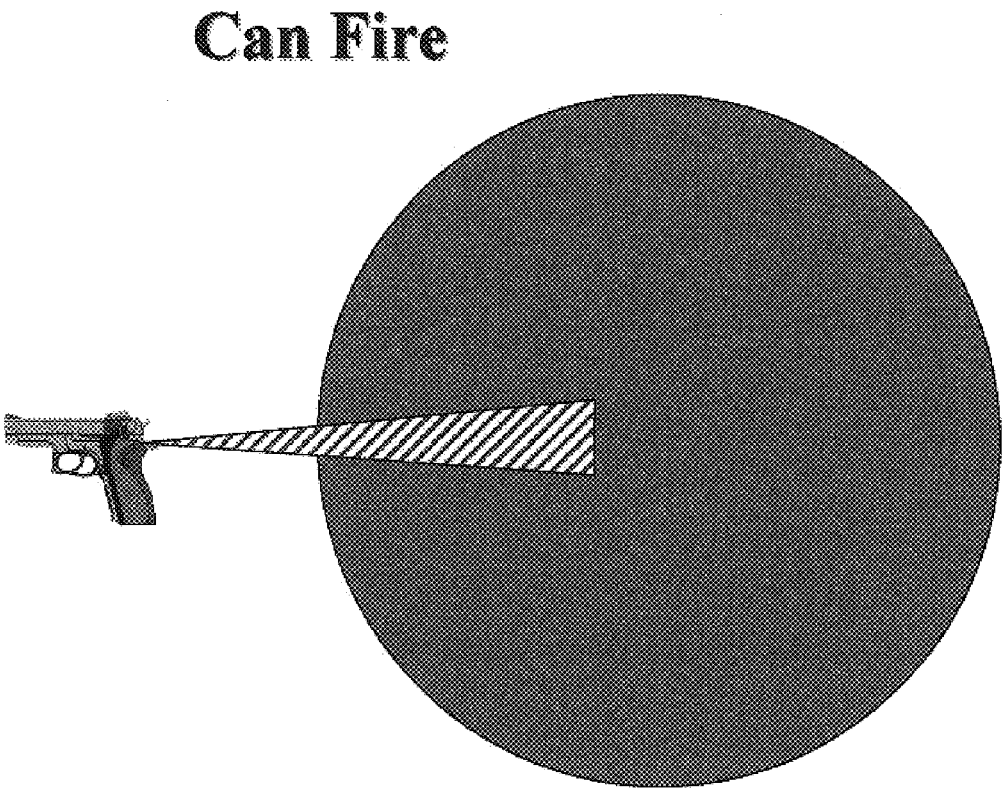
Figure 5C:
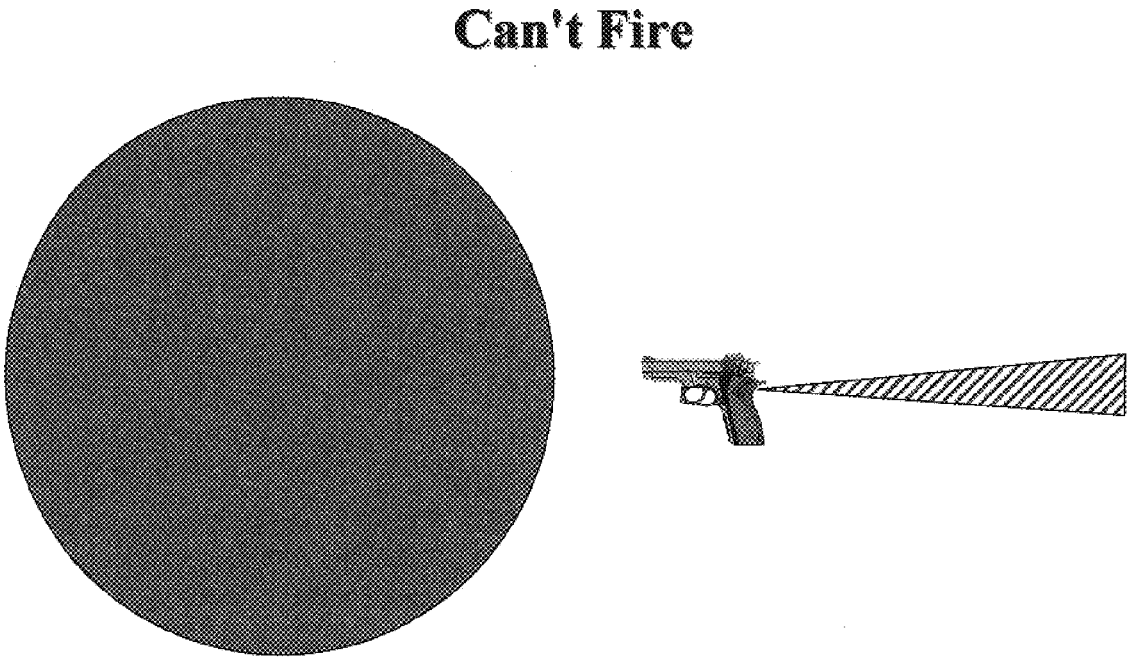

As shown in FIGS. 5A–5C, the method of the invention involves two steps. In step 1, the gun, in effect, transmits a coded signal. In step 2, a coded reply signal is received back by the gun. The gun is then authorized to fire only if the reply signal is an appropriate response and if the reply signal is directed to the gun from a predetermined direction relative to the gun. Otherwise, the gun is not enabled for use even though the reply signal is an appropriate response. Thus, as shown in FIG. 5B, if the authorized user is behind the gun, the gun is enabled to fire. However, if the authorized user is in front of the gun, it is not enabled and cannot fire.

An additional feature of apparatus 10 is the provision of an electronic record of the use of the gun. As noted, electronics unit EU includes a memory unit MEU. Each time gun 12 is fired, data is provided to the memory which records the time, date and the authorized user employing the weapon at that time. A sensor N (see FIG. 2) senses movement of the gun's hammer H. An internal clock built into the electronics unit provides time information. Additionally, an optional global positioning unit GPU can be used to provide location information. To download this information from memory MEU, electronics unit EU receives a specific interrogation code or codes (which codes are different than the authorizing code). In response, memory unit MEU provides its stored data to transmitter TEU of the electronics unit for transmission to data receiver. Included in this transmission is the license number of the weapon. It will be noted that while the authorizing codes are unique to the gun they enable, the interrogating codes for data retrieval are universal codes available to the police and other law enforcement and other investigative agencies. Further, the activation code takes precedence over a data retrieval code and the downloaded data will not include the authorizing code for the weapon. Also, the use of codes allows for future developments in other areas. For example, in a courtroom or schoolroom setting, universal transmission of certain codes would override authorization of the weapon and inhibit the use of the gun in these settings.

Both electronics unit EU and authorization unit AU are fabricated in very compact form which parallels a RFID format using thin film technology. Importantly, apart from details of their operation, and directionality, these units employ existing technologies and utilize radio frequencies standard within the industry; for example, they can be implemented using "Bluetooth" technology. Both units are acceptable to Class 15 services.

Again with respect to FIGS. 5A–5C, the importance of the apparatus and method of the present invention is that the weapon is authorized for use only when the authorized user is in a preferred position with respect to the weapon. That is, when the user is behind the weapon and the muzzle of the weapon is pointed away from him, the condition shown in FIG. 5B. In a law enforcement situation, if a police loses his weapon in a struggle with a criminal, the criminal cannot shoot the officer with the weapon because it will not fire, the condition shown in FIG. 5C. This is so, even if the assailant also has an authorization unit; because, as discussed, each unit is unique to a particular weapon. Were the person who got the weapon away from the policeman to try to use the weapon in commission of another crime, it would not fire. This does not mean that the fright effect caused by having the weapon pointed at someone would still not be there, but the victim could not be shot with the weapon.

In hunting situations, if the hunter were to drop a loaded weapon because of an accident or carelessness, the weapon would not discharge if the muzzle were to somehow come to be pointed at the user. Again, this is the condition shown in FIG. 5C. In home environments, a toddler or child who came across a weapon could not inadvertently shoot himself or another because the apparatus would not allow the weapon to fire.

While the foregoing discussion is directed to use of the apparatus and method of the invention in firearm's safety, those skilled in the art will appreciate that it can be used to effect user control of a myriad of appliances. These include home appliances such as televisions and VCR's, kitchen appliances such as stoves, laundry or bathroom items such as steam irons, hair dryers, curling irons, etc. That is, appliances where the ability to control when the device is turned on or off has safety implications and prevents injury, for example, to small children or senile adults who might otherwise inadvertently injure themselves. Alternatively, the invention prevents those who have no legitimate reason to be using someone else's property from using it. In industrial settings, machine tools can similarly be controlled so that only persons having the "right" to the use the equipment can turn it on and use it. If the person's position relative to the equipment can be such that they can be injured by the equipment, the apparatus and method of the present invention will insure that the equipment is activated only so long as the user remains in a safe position relative to the equipment; i.e., a position where he cannot be injured by it.

The apparatus and method may also be employed for theft prevention. Movable items such as automobiles, carts such as golf carts, trucks, vans, etc. can be effectively prevented from being started and driven away by incorporating the apparatus and method of the invention with the ignition or fuel delivery system of a vehicle, including those which are battery powered. Also included in this category of appliances also includes computer related appliances such as PC's and their associated peripherals, cellular phones, and other portable equipment. Here, while it may be possible to steal the appliance, the appliance is unusable by the thief. In each of these applications, the authorized user wears a badge or tag 14 and electronics unit EU is installed in the appliance. The apparatus further includes the two antennas A1 and A2, the antenna A1 being the omni-directional antenna, and antenna A2 providing the directional sensitivity.

Figure 6:
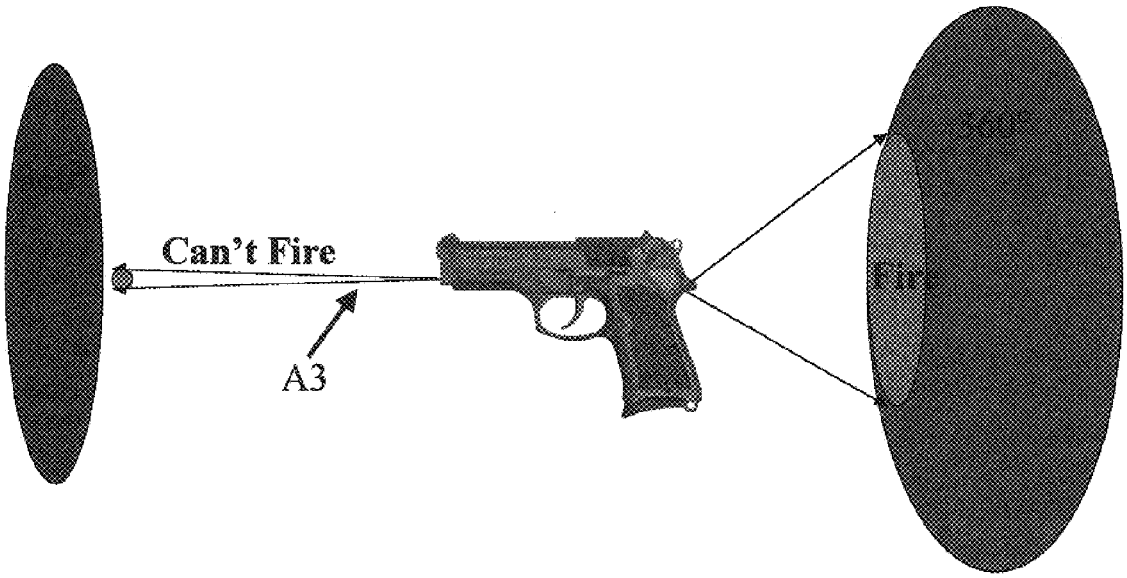

In an additional application, as shown in FIG. 6, a third antenna A3 is employed by the apparatus. As with antenna A2, this antenna A3 is also a directional antenna. Antenna A3 is, however, pointed in a direction in which, for example, use of the appliance may cause injury to a person. Further, antenna A3 has a very narrow cone for directionality; for example, 5°. In the above described firearm example, antenna A3 points in the direction of the muzzle of the gun. Now, operation of the apparatus and method of the invention is such that the weapon is authorized for use in the manner previously described. However, if another authorized person, a policeman for example, moves in front of the weapon, the weapon is disabled for so long as he is there; and is enabled as soon as he moves away from in front of the muzzle. This feature prevents injury due to "friendly fire". Those skilled in the art will recognize that this feature has significant military implications for combat. In industrial settings, this feature protects co-workers from inadvertent injuries if they come too close to the operating portion of a piece of equipment while it is in use. The advantage that this feature provides is that the authorized user actually operating the appliance does not to even have to be aware of the presence of the other for the safety feature to work.

Finally, in all of the above described applications, the apparatus and method of the invention have involved a person interacting with the appliance. Those skilled in the art, however, will recognize that there are applications where one appliance may be able to interact with one or more other appliances. Here, the user control issue is that it may desirable, or in some circumstances necessary, for the first appliance to interact with only one of the other appliances, and then only so long as the other appliance is a preferred orientation with respect to the first appliance. The apparatus and method of the present invention provide a way for accomplishing this.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. An apparatus for limiting usage of an associated appliance to an authorized user, comprising:

an electronic unit operatively coupled to the associated appliance, said electronic unit configured to regulate activation of the associated appliance;

at least one authorizing unit associated with an authorized user, said authorizing unit configured to periodically emit a signal representative of a unique message;

wherein said electronic unit is further configured to receive said signal; and wherein said electronic unit is further configured to calculate a differential strength of said signal to identify a spatial relationship including at least a distance and orientation of said at least one authorizing unit relative to said electronic unit; and wherein said electronic unit is further configured to activate the associated appliance only in response to said unique message corresponding to a predetermined message and said identified spatial relationship establishing a presence of said at least one authorizing unit within a predetermined limited spatial volume relative to said electronic unit, said electronic unit including an omni-directional antenna having a first signal detection region and a directionally sensitive antenna having a second signal detection region; and wherein an intersection of said first and second signal detection regions defines said predetermined limited spatial volume relative to said electronic unit, and said electronic unit being configured to calculate said differential signal strength utilizing a signal received at said omni-directional antenna and a signal received at said directionally sensitive antenna.

2. The apparatus of claim 1 wherein the directionally sensitive antenna has a gain of at least 3 dB in the horizontal plane, thereby to provide approximately a 180° range of coverage in the horizontal plane.

3. The apparatus of claim 1 further including a second directional sensitive antenna having a third signal detection region which is pointed in a different direction than said second signal detection region.

4. The apparatus of claim 3 in which the second directionally sensitive antenna has a range of coverage in the horizontal plane narrower than that of said first directionally sensitive antenna.

5. The apparatus of claim 4 in which the range of coverage of the second directionally sensitive antenna is approximately 5°.

6. The apparatus of claim 3 wherein said electronic control unit is configured to disable the associated appliance even though an appropriate response signal directed to the interrogation means is received by from the first directionally sensitive antenna, if another appropriate response signal directed to said electronic control unit is received by said second directionally sensitive antenna.

7. The apparatus of claim 6 wherein said electronic control unit is configured to enable the associated appliance when an appropriate response signal is no longer received by said second directionally sensitive antenna but an appropriate response signal continues to be received by said first directionally sensitive antenna.

8. The apparatus of claim 1 further including recording means recording information concerning usage of the associated appliance including who used the associated appliance and when the associated appliance was used.

9. The apparatus of claim 8 wherein the recording means further records the place of usage of the associated appliance.

10. The apparatus of claim 1 where said electronic unit is further configured to active the associated appliance for a predetermined period of time in response to said unique message corresponding to said predetermined message and said identified spatial relationship establishing a presence of said at least one authorizing unit within said predetermined limited spatial volume relative to said electronic unit.

11. The apparatus of claim 1 wherein said electronic unit is further configured to deactivate the associated appliance responsive to a subsequent unique message from said at least one authorizing unit different from a second predetermined message.

12. The apparatus of claim 1 wherein said electronic unit is further configured to deactivate the associated appliance responsive to a calculated differential signal strength of a subsequent signal from said at least one authorizing unit establishing a presence of said at least one authorizing unit external to said predetermined limited spatial volume relative to said electronic unit.

13. The apparatus of claim 1 wherein said electronic unit is further configured to periodically emit a signal representative of a unique interrogation message; and wherein said at least one authorizing unit is configured to receive said signal representative of said unique interrogation message and to emit said signal representative of said unique message responsive to a received unique interrogation message corresponding to a predetermined interrogation message.

14. The apparatus of claim 1 wherein said associated appliance is a firearm; and wherein said electronic unit is operatively coupled to said firearm to inhibit discharge of said firearm in a first state, and to permit discharge of said firearm in a second state, responsive to said unique message corresponding to a predetermined message and said identified spatial relationship establishing a presence of said at least one authorizing unit within a predetermined limited spatial volume relative to said electronic unit.

15. The apparatus of claim 14 wherein said firearm includes a barrel having a muzzle defining a discharge axis and a discharge direction; and wherein said predetermined limited spatial volume is disposed about said discharge axis for a predetermined distance opposite said discharge direction from said firearm muzzle.

16. The apparatus of claim 1 wherein said predetermined limited spatial volume is conical.

17. A method for limiting usage of an appliance to an authorized user, comprising:

regulating activation of the appliance from a deactivate state with an electronic control unit having first and second signal receivers;

emitting a signal representative of a unique message from an at least one authorizing unit;

receiving said signal at said first and second signal receivers;

calculating a differential strength of said signal received at said first and second signal receivers;

identifying a spatial relationship from at least said calculated differential strength, said identified spatial relationship including at least a distance between said at least one authorizing unit emitting said signal and said electronic control unit and at least a relative orientation between said at least one authorizing unit emitting said signal and said electronic control unit; and responsive to said identified spatial relationship establishing a presence of said at least one authorizing unit within a predetermined limited spatial volume relative to said electronic unit and said unique message corresponding to a predetermined message, activating the appliance.

18. The method of claim 17 wherein said activating step activates the appliance for a predetermined interval.

19. The method of claim 18 further including periodically repeating said steps of emitting, receiving, identifying, and activating.

20. The method of claim 19 wherein said steps of emitting, receiving, identifying, and activating are periodically repeated at a frequency greater than said predetermined interval.

21. The method of claim 17 further including the step of deactivating the appliance responsive to said identified spatial relationship establishing a presence of said at least one authorizing unit external to a predetermined limited spatial volume relative to said electronic unit.

22. The method of claim 17 further including the step of deactivating the appliance responsive to said unique message not corresponding to a predetermined message.

23. An apparatus for limiting usage of a firearm to an authorized user, the firearm having a muzzle defining a discharge axis and a discharge direction, comprising:

an electronic unit operatively coupled to the associated appliance, said electronic unit configured to regulate activation of the associated appliance;

at least one authorizing unit associated with an authorized user, said authorizing unit configured to periodically emit a signal representative of a unique message;

wherein said electronic unit is further configured to receive said signal; and wherein said electronic unit is further configured to identify a spatial relationship between said at least one authorizing unit and said electronic unit, and said spatial relationship includes at least a distance and orientation; and wherein said electronic unit is operatively coupled to the firearm to inhibit discharge of the firearm in a first state, and to permit discharge of the firearm in a second state, responsive to said unique message corresponding to a predetermined message and said identified spatial relationship establishing a presence of said at least one authorizing unit within a predetermined limited spatial volume relative to said electronic unit, said predetermined limited spatial volume being disposed about the discharge axis for a predetermined distance opposite the discharge direction from the firearm muzzle.

24. The apparatus of claim 23 where said electronic unit is further configured to active the firearm for a predetermined period of time in response to said unique message corresponding to said predetermined message and said identified spatial relationship establishing a presence of said at least one authorizing unit within said predetermined limited spatial volume relative to said electronic unit.

25. The apparatus of claim 23 wherein said electronic unit is further configured to deactivate the firearm responsive to a subsequent unique message from said at least one authorizing unit different from a second predetermined message.

26. The apparatus of claim 23 wherein said electronic unit is further configured to deactivate the firearm responsive to a calculated differential signal strength of a subsequent signal from said at least one authorizing unit establishing a presence of said at least one authorizing unit external to said predetermined limited spatial volume relative to said electronic unit.

27. The apparatus of claim 23 wherein said electronic unit includes an omni-directional antenna having a first signal detection region and a directionally sensitive antenna having a second signal detection region; and, wherein an intersection of said first and second signal detection regions defines said predetermined limited spatial volume relative to said electronic unit.

28. The apparatus of claim 27 wherein said electronic unit is configured to calculate a differential signal strength utilizing a signal received at said omni-directional antenna and a signal received at said directionally sensitive antenna.

29. The apparatus of claim 23 wherein said electronic unit is further configured to periodically emit a signal representative of a unique interrogation message; and wherein said at least one authorizing unit is configured to receive said signal representative of said unique interrogation message and to emit said signal representative of said unique message responsive to a received unique interrogation message corresponding to a predetermined interrogation message.

30. The apparatus of claim 23 wherein said predetermined limited spatial volume is conical.

* * * * *